US009758990B2

(12) United States Patent
Beck

(10) Patent No.: US 9,758,990 B2
(45) Date of Patent: Sep. 12, 2017

(54) DEADBOLT WITH STATUS INDICATOR LIGHT

(71) Applicant: KWIKSET CORPORATION, Lake Forest, CA (US)

(72) Inventor: Chasen Scott Beck, Cypress, CA (US)

(73) Assignee: Spectrum Brands, Inc., Middleton, WI (US)

( * ) Notice: Subject to any disclaimer, the term of this patent is extended or adjusted under 35 U.S.C. 154(b) by 124 days.

(21) Appl. No.: 13/905,417

(22) Filed: May 30, 2013

(65) Prior Publication Data

US 2014/0353980 A1 Dec. 4, 2014

(51) Int. Cl.

| | |
|---|---|
| ***E05C 1/04*** | (2006.01) |
| ***E05C 17/56*** | (2006.01) |
| ***E05C 19/16*** | (2006.01) |
| ***E05B 41/00*** | (2006.01) |
| ***E05B 17/22*** | (2006.01) |
| ***E05C 1/06*** | (2006.01) |
| ***E05B 17/10*** | (2006.01) |
| *E05B 47/00* | (2006.01) |
| *E05B 63/00* | (2006.01) |

(52) U.S. Cl.

CPC ..... *E05B 41/00* (2013.01); *E05B 17/10* (2013.01); *E05B 17/22* (2013.01); *E05C 1/06* (2013.01); *E05B 63/0017* (2013.01); *E05B 2047/0058* (2013.01); *Y10T 292/1022* (2015.04)

(58) Field of Classification Search

CPC ... Y10T 29/49826; E05B 41/00; E05B 65/06; E05B 47/004; E05B 47/0041; E05B 47/0042; E05B 47/0043; E05B 47/0044; E05B 47/0038; E05B 47/0045; E05B 39/00; E05B 39/04; E05B 17/22; E05B 35/001; E05B 45/06; G07C 1/32

USPC ..... 292/145, 137, 138, 163, 169, 140, 357, 292/251.5; 70/276, 432–434, DIG. 51

See application file for complete search history.

(56) References Cited

U.S. PATENT DOCUMENTS

| | | | | |
|---|---|---|---|---|
| 1,286,344 A * | 12/1918 | Kenneweg | ..... | E05B 55/00 292/140 |
| 3,643,249 A * | 2/1972 | Haywood | ..... | E05B 41/00 200/61.64 |
| 3,866,164 A * | 2/1975 | Peterson | ..... | E05B 45/06 200/61.64 |

(Continued)

FOREIGN PATENT DOCUMENTS

| | | |
|---|---|---|
| JP | 10-212849 | 8/1998 |
| JP | 2008-261138 | 10/2008 |

OTHER PUBLICATIONS

PCT International Search Report; Sep. 17, 2014.

(Continued)

*Primary Examiner* — Kristina Fulton
*Assistant Examiner* — Faria Ahmad
(74) *Attorney, Agent, or Firm* — Barnes & Thornburg LLP

(57) ABSTRACT

A deadbolt lock with an interior assembly having a status light indicator. The deadbolt assembly has a bolt movable between an extended position and a retracted position. An interior locking assembly includes a turnpiece configured to move the bolt between its extended position and retracted position, a light, and a detection circuit. The detection circuit is configured to detect when the bolt is in the extended position and actuate the light responsive to detecting that the bolt being in the extended position.

3 Claims, 5 Drawing Sheets

(56) References Cited

U.S. PATENT DOCUMENTS 3,893,723 A * 7/1975 Boule ..... E05B 47/0002 292/140
4,293,894 A * 10/1981 Blank ..... E05B 17/10 362/100
4,509,347 A * 4/1985 Young ..... E05B 47/0002 292/140
4,516,114 A * 5/1985 Cook ..... G08B 13/08 340/542
4,559,796 A * 12/1985 De Forrest, Sr. ..... E05B 41/00 70/432
4,683,741 A * 8/1987 Fields ..... E05B 17/10 109/38
4,760,380 A * 7/1988 Quenneville ..... E05B 17/10 340/542
5,111,007 A * 5/1992 Miller ..... E05B 17/10 116/286
5,179,325 A * 1/1993 Aragon, Jr. ..... E05B 17/10 315/129
6,441,735 B1 * 8/2002 Marko ..... E05B 45/083 340/542
6,461,013 B1 * 10/2002 Simon ..... E05B 17/10 362/100
6,552,655 B2 * 4/2003 Barbulescu ..... B60Q 9/00 340/426.11
6,584,818 B2 * 7/2003 Bates ..... E05B 47/0607 70/107
6,622,537 B2 * 9/2003 Rodriguez ..... E05B 17/10 362/100
6,950,033 B1 * 9/2005 Guyre ..... E05B 17/10 340/542
7,108,387 B1 * 9/2006 Lucas ..... E05B 1/0007 200/61.62
7,172,306 B1 * 2/2007 Campa ..... E05B 17/10 362/100
7,357,429 B2 * 4/2008 Eichenauer ..... E05B 47/0046 292/144
7,866,195 B2 * 1/2011 Levine ..... E05B 41/00 116/80
7,990,280 B2 * 8/2011 Gray ..... G08B 7/062 340/540
8,093,986 B2 * 1/2012 Harvey ..... E05B 37/00 235/382
9,080,349 B2 * 7/2015 Burrus ..... E05B 37/00
2003/0024288 A1 2/2003 Gokcebay et al.
2006/0038419 A1 * 2/2006 Lee ..... E05B 15/02 292/357
2006/0042336 A1 * 3/2006 Smith ..... E05B 13/004 70/432
2006/0144103 A1 * 7/2006 Blanch ..... E05B 41/00 70/330
2006/0145485 A1 * 7/2006 Hapke ..... A47L 15/4259 292/251.5
2006/0191305 A1 * 8/2006 Golubev ..... E05B 27/08 70/276
2006/0192396 A1 * 8/2006 Frolov ..... E05B 45/12 292/169
2007/0069894 A1 * 3/2007 Lee ..... E05B 45/06 340/542
2007/0131007 A1 * 6/2007 Hacker ..... E05B 39/00 70/433
2007/0204662 A1 * 9/2007 Pullmann ..... E05B 15/101 70/277
2008/0217928 A1 * 9/2008 Spurr ..... E05B 81/20 292/198
2008/0295548 A1 * 12/2008 Misner ..... E05B 35/105 70/21
2008/0297344 A1 12/2008 Yang
2009/0027197 A1 * 1/2009 Frolov ..... E05B 45/06 340/542
2009/0273440 A1 * 11/2009 Marschalek ..... E05B 9/08 340/5.61
2010/0180649 A1 * 7/2010 Harvey ..... E05B 37/00 70/277
2012/0036904 A1 * 2/2012 Chang ..... E05B 47/02 70/91
2012/0167646 A1 7/2012 Sharma et al.
2012/0180536 A1 * 7/2012 Miller ..... E05B 9/00 70/278.1
2012/0186312 A1 * 7/2012 Lowder ..... E05B 17/22 70/263
2013/0145802 A1 * 6/2013 Eichenstein ..... E05B 41/00 70/432
2014/0250959 A1 * 9/2014 Tsai ..... E05B 47/0044 70/491
2014/0311197 A1 * 10/2014 Abel ..... E05B 41/00 70/432

OTHER PUBLICATIONS

Front and rear photos of product packaging for Night Hawk Deadbolt Security Indicator showing instructions for installation, dated 2008; 3 pages.

* cited by examiner

DEADBOLT WITH STATUS INDICATOR LIGHT

TECHNICAL FIELD

This disclosure relates generally to mechanical locking devices; in particularly, this relates to a deadbolt with a light that indicates whether the deadbolt is locked.

BACKGROUND

Deadbolt locks are well known. The exterior portion includes a keyhole for receiving a key to lock/unlock the deadbolt. The interior portion typically has a turnpiece that is used to lock/unlock the deadbolt. The user may rotate the turnpiece to move the deadbolt between a locked and unlocked position. From the interior of the door, the position of the turnpiece provides a visual indicator of whether the deadbolt is locked or not. However, the position of the turnpiece can be difficult to see from a distance or in low light conditions. Accordingly, it can be difficult to determine whether a deadbolt is locked from a distance or in low light conditions.

SUMMARY

According to one aspect, this disclosure provides a deadbolt assembly in which a light is actuated when the deadbolt is locked. In one embodiment, the deadbolt assembly has a bolt movable between an extended position and a retracted position. An interior locking assembly is provided that defines an interior cavity. The interior locking assembly includes a turnpiece configured to move the bolt between its extended position and retracted position, a light, such as an LED, and a detection circuit disposed in the interior cavity. The detection circuit is configured to detect when the bolt is in the extended position and actuate the light responsive to detecting that the bolt being in the extended position.

In some cases, the interior locking assembly may include a magnet that is movable with the turnpiece and the detection circuit may include a magnetic sensor, such as a Hall effect sensor, configured to actuate the light responsive to either: (1) detecting the magnet; or (2) detecting the absence of the magnet. In some embodiments, the magnet may be disposed in the interior cavity. For example, the magnet could be carried on a shank of the turnpiece. In some cases, for example, the magnet could be attached to a magnet carrier that has a passage dimensioned to receive the shank of the turnpiece.

Depending on the circumstances, the magnet could be movable between a first position corresponding with a position in which the bolt is in an extended position and a second position corresponding with a position in which the bolt is in a retracted position. In some cases, in which the light is actuated based on the presence of the magnet, the magnet could be positioned on the shank to be detectable by the magnetic sensor in the first position and undetectable by the magnetic sensor in the second position. Other embodiments are contemplated in which the light is actuated based on the absence of the magnet. In such embodiments, the magnet could be positioned on the shank to be undetectable by the magnetic sensor in the first position and detectable by the magnetic sensor in the second position.

In some embodiments, the interior locking assembly includes a rose that defines an opening through which the light may illuminate. In some cases, the interior locking assembly includes a battery holder with a portion that forms a substantially uninterrupted and continuous exterior surface with the rose.

According to another aspect, this disclosure provides a deadbolt assembly with a bolt movable between an extended position and a retracted position and a turnpiece configured to move the bolt between the extended position and the retracted position. A magnet may be provided that is movable with the turnpiece. A processor could be provided that is electrically coupled with a light and a magnetic sensor. The processor could be configured to actuate the light responsive to the magnetic sensor either: (1) detecting the magnet; or (2) detecting the absence of the magnet.

According to a further aspect, this disclosure provides a deadbolt assembly with a bolt movable between an extended position and a retracted position and an interior locking assembly defining an interior cavity. The interior locking assembly includes a turnpiece configured to move the bolt between the extended position and the retracted position and a light. The interior locking assembly also includes means for actuating the light responsive to the bolt being in the extended position. In this embodiment, the actuating means is entirely disposed in the interior cavity.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereafter with reference to the attached drawings which are given as non-limiting examples only, in which.

Figure 1:
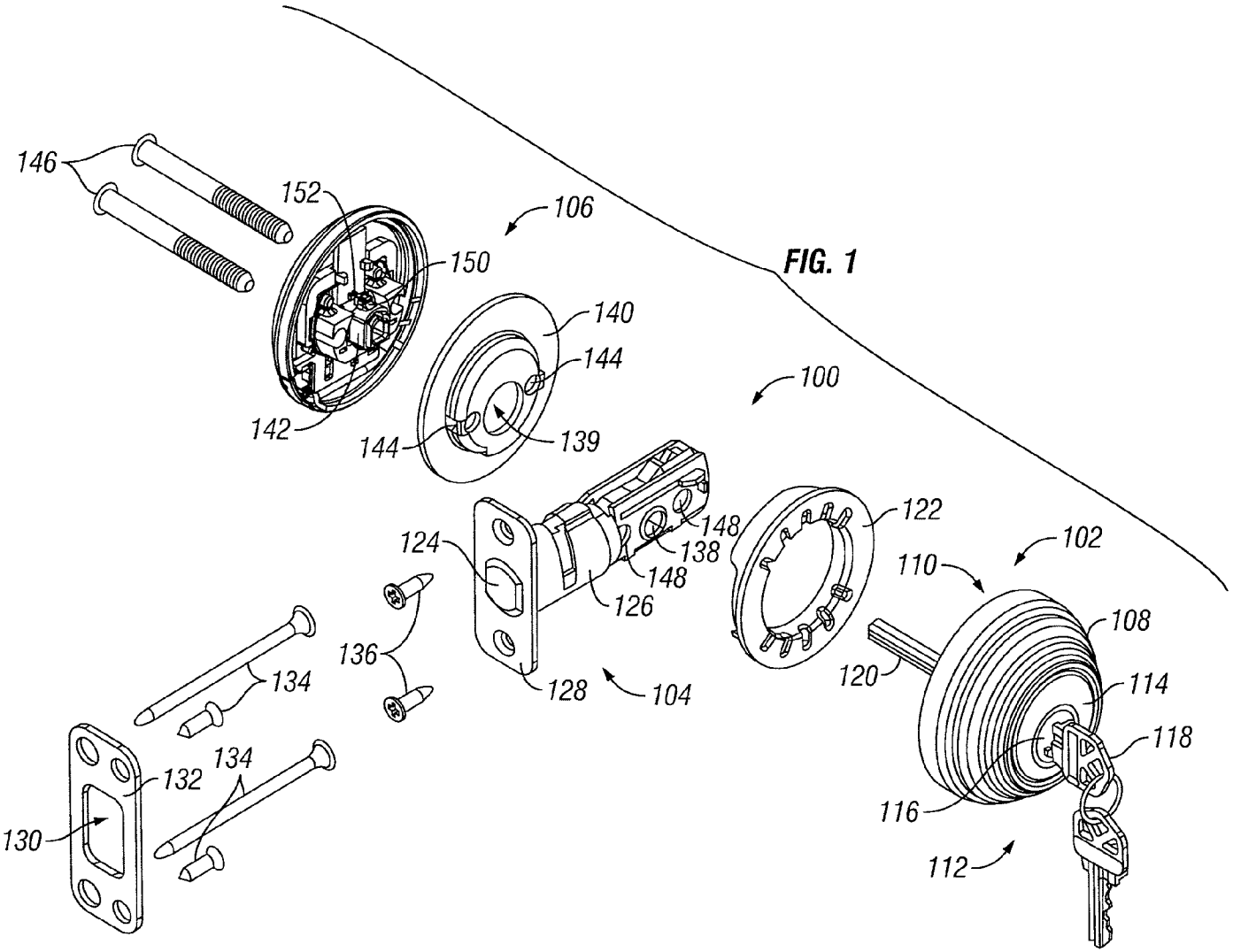
FIG. 1 is an exploded view of an example lock assembly according to one embodiment of the disclosure.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

FIG. 1 shows an example lock assembly 100 according to one embodiment of the disclosure. In this embodiment, the lock assembly 100 is shown in the form of a deadbolt. As shown, the lock assembly 100 includes an exterior assembly 102, a latch assembly 104, and an interior assembly 106. Typically, the exterior assembly 102 is mounted on the outside of a door, while the interior assembly 106 is mounted inside a door. The latch assembly 104 is typically mounted in a bore formed in the door. The term "outside" is broadly used to mean an area outside a door and "inside" is also broadly used to denote an area inside a door. With an exterior entry door, for example, the exterior assembly 102 may be mounted outside a building, while the interior assembly 106 may be mounted inside a building. With an interior door, the exterior assembly may be mounted inside a building, but outside a room secured by the lock assembly 100; the interior assembly 106 may be mounted inside the secured room. The lock assembly 100 is applicable to both interior and exterior doors.

As shown, the exterior assembly 102 includes a cylinder guard cover 108 that houses internal components of the exterior assembly 102. In the example shown, the cylinder guard cover 108 has a decorative shape with a rear portion 110 that would be adjacent a door (not shown) and a front portion 112 extending from the door. In this example, the cylinder guard cover 108 has a tapered shape from the rear portion 110 to the front portion 112, but the exterior assembly 102 and cylinder guard cover 108 could have a wide variety of different sizes and shapes depending on the particular circumstances.

In the embodiment shown, the front portion 112 of the exterior assembly 102 includes a front cover 114 that surrounds a mechanical locking assembly 116. A mechanical key 118 may be inserted into the mechanical lock assembly 116 to mechanically unlock the lock assembly 100. An example of components that could be used for locking and unlocking the exterior assembly 102 is shown in U.S. Pat. No. 6,860,131, which is hereby incorporated by reference. However, this is merely an example and this disclosure is not limited to the type of locking/unlocking arrangement disclosed in that patent.

In the example shown, the exterior lock assembly 102 has a torque blade 120 extending from the rear portion 110. The torque blade 120 extends through an adaptor 122 in the embodiment shown, which is received within a bore in a door to which the lock assembly 100 is being installed or mounted.

The latch assembly 104 is disposed in a core in a door and may be actuated manually by the mechanical lock assembly 116 to extend/retract a bolt 124 in the embodiment shown. The bolt 124 moves linearly in and out of a sleeve 126. When the bolt 124 is retracted, an end of the bolt 124 is generally flush with a base plate 128. When the bolt 124 is extended, the bolt 124 protrudes through an edge bore in the door into an opening 130 of a strike plate 132, which is positioned in a jamb adjacent the door. As is typical, the strike plate 132 is attached to the jamb using fasteners 134. Likewise, fasteners 136 attach the base plate 128 of the latch assembly 104 to a door.

In the embodiment shown, the latch assembly 104 includes a spindle 138 that is drivable in a first direction to extend the bolt 124 and a second direction to retract the bolt 124. The spindle 138 is configured to receive the torque blade 120 such that rotation of the torque blade 120 in a first direction extends the bolt 124; whereas, rotation of the torque blade 120 in the opposite direction causes the spindle to retract the bolt 124.

The torque blade 120 extends through the latch assembly 104 into an opening 139 in a mounting plate 140, which is attached to an interior side of a door. The torque blade 120 passes through the opening 139 and is received by a spindle driver 142. The spindle driver 142 rotates based on rotation of a turnpiece 143 (FIGS. 2 and 3), which can be manually rotated by the user to control of the position of the bolt 124. Since the torque blade 120 is disposed within the spindle 138, rotation of the spindle driver 142 may be used to extend and/or retract the bolt 124 of the latch assembly 104 via the turnpiece 143. In the embodiment shown, fasteners 146 extend through holes 144 in the mounting plate 140, which are aligned with openings 148 in the latch assembly 104.

In one embodiment, as explained below, the spindle driver 142 carries a magnet 150 that moves concomitant with the spindle driver 142. A magnetic sensor 152, such as a Hall effect sensor, is positioned proximate the path of the magnet to detect when the spindle driver 142 position corresponds with the bolt 124 being in an extended or retracted position. A light 154 (FIGS. 2 and 3) could be turned on (or flashed) based on the bolt's 124 position sensed by the magnetic sensor 152 to indicate whether the lock assembly 100 is locked or unlocked to the user. This can be particularly helpful in low light conditions or if the user is trying to determine whether the lock assembly 100 is locked/unlocked from a distance.

Figure 2:
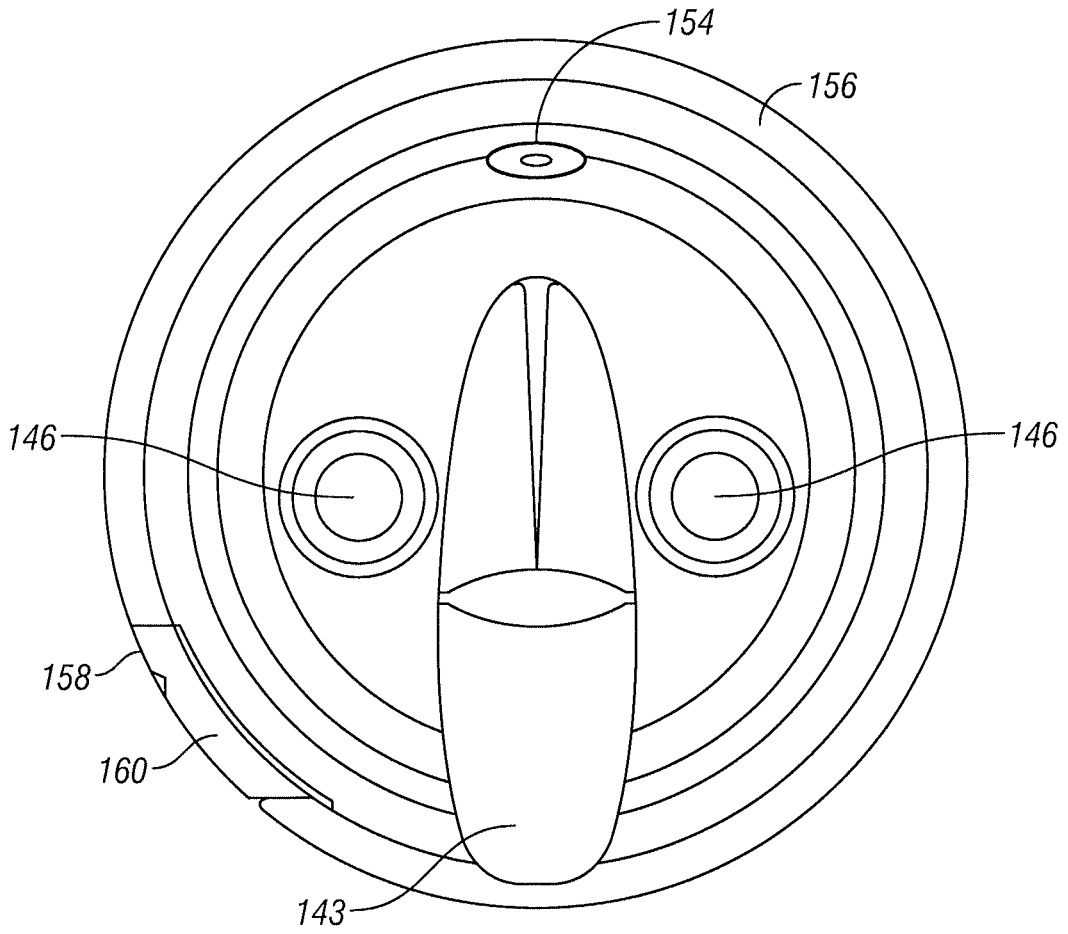
FIG. 2 is a front view of the interior locking assembly according to one embodiment of the disclosure.

FIG. 2 is a front view of the example interior assembly 106. In the example shown, the interior assembly 106 includes a rose 156 (also called an escutcheon) that acts as a cover for the interior assembly 106. The rose 156 is typically a decorative piece that could be formed in a variety of shapes, styles and designs; accordingly, the rose 156 shown in the figures is merely for purposes of example and this disclosure should not be limited to that example rose 156.

The turnpiece 143 extends from the rose 156 and is rotatable to lock and unlock the lock assembly 100. As discussed above, rotation of the turnpiece 143 causes concomitant rotation of the torque blade 120, which moves the bolt 124 between its retracted and extended positions. The fasteners 146 attach the interior assembly 106 to a door.

Figure 3:
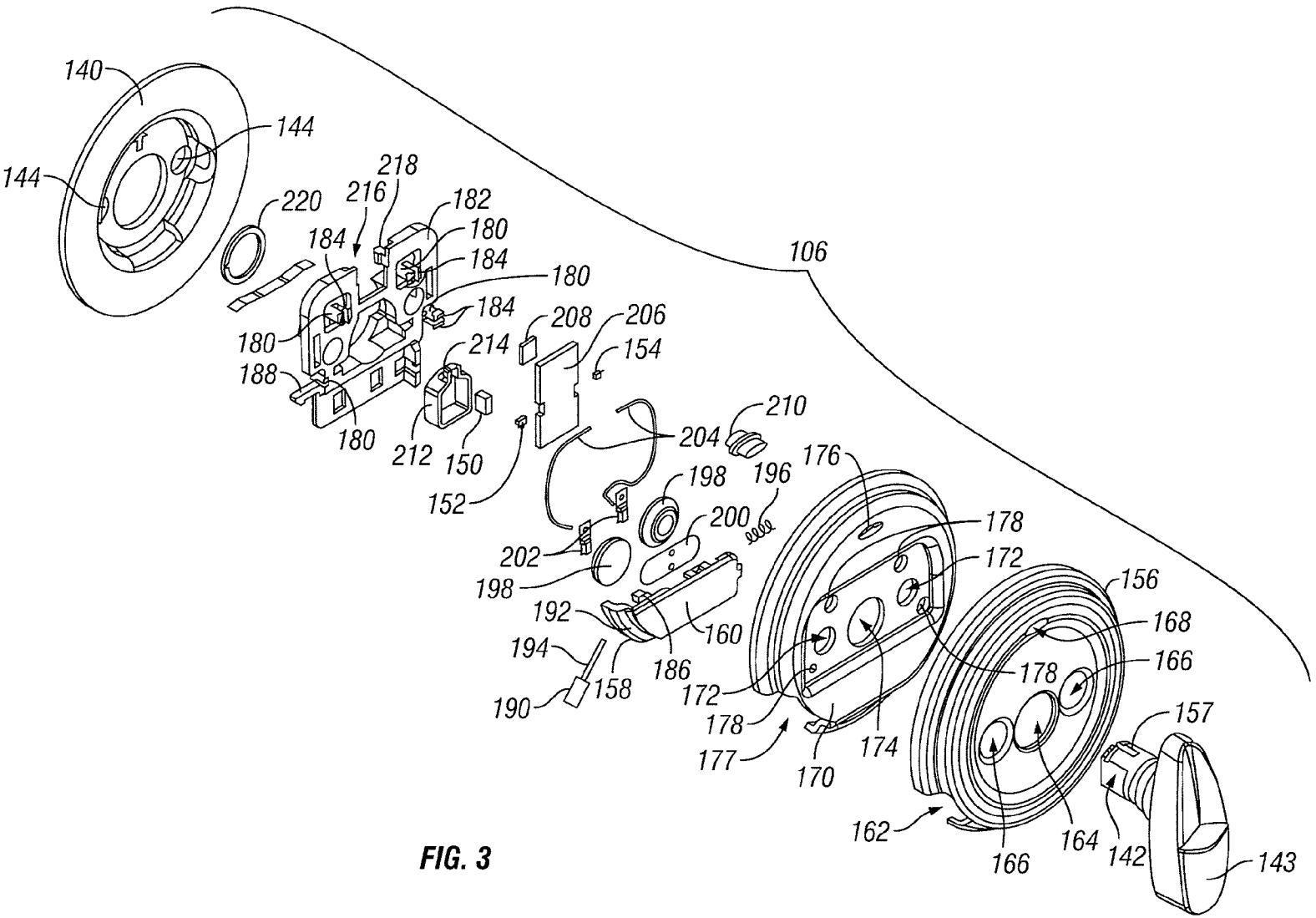
FIG. 3 is an exploded view of the interior locking assembly according to one embodiment.

In the embodiment shown, an end 158 of a battery holder 160 forms a portion of the rose 156. The battery holder 160 is dimensioned to hold one or more batteries to power electronics associated with the interior assembly 106. As best seen in FIG. 3, the rose 156 includes a cutout portion 162 that is dimensioned to receive the battery holder 160. As shown, the end 158 forms a substantially continuous and uninterrupted exterior surface with the rose 156.

FIG. 3 is an exploded view of the example interior assembly 106 according to one embodiment. As shown, the turnpiece 143 has a shank 157 terminating in a spindle driver 142 that is received in a bore 164 defined in the rose 156. Holes 166 are also defined in the rose 156 for receiving fasteners 146. In this embodiment, the rose 156 defines an opening 168 through which the light 154 may illuminate. Although the opening 168 in the example shown is on the face of the rose 156, the opening could be on the edge or side of the rose 156. For example, the light 154 could extend outside the rose 156 through an opening on the edge or other area.

The rear portion of the rose 156 is formed to receive a liner 170. The liner 170 includes holes 172 corresponding to holes 166 in the rose 156 for receiving fasteners 146. A bore 174 is defined in the liner 170 corresponding to the bore 164 in the rose 156 that is dimensioned to receive the spindle driver 142 of the turnpiece 143. The liner 170 defines an opening 176 corresponding to the opening 168 in the rose 156 for providing an opening through which light 154 illuminates. The liner 170 also includes a cutout portion 177 corresponding to the cutout portion 162 in the rose 156 for receiving the battery holder 160. The liner 170 defines apertures 178 that are dimensioned to receive slotted pins 180 extending from a holder 182. The slots allow the pins 180 to be received in the apertures 178 in the liner 170 and then spring outwardly so that flanges 184 create an interference fit between the holder 182 and the liner 170. Although an interference fit between the holder 182 and the liner 170 is shown for purposes of example, one skilled in the art should appreciate that other fastening techniques could be used, such as a frictional fit, unitary formation, adhesive, etc.

The battery holder 160 is received in the cutout portions 162, 177 of the rose 156 and liner 170. In the example shown, the battery holder 160 includes a knob 186 that is received by a lever 188 in the holder 182 to form an interference fit that locks the battery holder 160 to the holder 182. To release the battery holder 160, in the embodiment shown, a release tool 190 extends through a hole 192 defined in the end 158 of the battery holder 160. In the embodiment shown, the release tool 190 includes a prong 194 dimensioned to extend through the hole 192 to lift the lever 188, thereby releasing the knob 186. As shown, the battery holder 160 is urged out of the rose 156 by spring 196. Accordingly, when the lever 188 is lifted by the release tool 190, the spring 196 will move the battery holder 160 out of the rose 156.

One or more batteries 198 are held between a first contact plate 200 and a second contact plate 202. Wires 204 electrically connect the second contact plate 202 to a PCB board 206 containing electronics for illuminating light 154. Accordingly, batteries are electrically connected to supply power to the PCB board 206.

As shown, the PCB board 206 includes a processor 208 that is configured to illuminate the light 154, which could be an LED, based on the magnetic sensor 152. One skilled in the art should understand that various types of circuits could be used that take the magnetic sensor 152 as an input and supply power to the light 154 contingent on the input of the magnetic sensor. In other embodiments, a mechanical switch, such as a toggle switch, could be used to detect the position of the turnpiece. For example, the shank 157 of the turnpiece could have an extension that mechanically actuates a toggle switch when the bolt is in an extended position. In the example shown, the light 154 is received by an optional lamp cover 210, which could be a translucent or transparent member through which the light 154 illuminates.

In the embodiment shown, the magnet 150 is held by a magnet carrier 212. As shown, the magnet carrier 212 has an opening dimensioned to receive the spindle driver 142. Accordingly, the magnet carrier 212 rotates with the rotation of the spindle driver 142. The magnet carrier 212 includes a flange 214 with a recessed portion for receiving the magnet 150. As discussed above, the magnet 150 is proximate to the magnetic sensor 152. As a result, the magnetic sensor will be able to detect when the bolt 124 is in its retracted or extended position. For example, the processor 208 could be configured to illuminate the light 154 when the bolt 124 is in the extended position, which would indicate to a user that the locking assembly 100 is locked. This could be particularly helpful in determining whether the locking assembly 100 is locked in low light conditions or from a distance.

As shown, the holder 182 has a cutout portion 216 with clips 218 configured to receive and secure the PCB board 206. In this embodiment, the holder 182 includes a bore corresponding with the bores 164, 174 in the rose 156 and liner 170. A clip 220 is provided to provide an interference fit with a grove in the turnpiece 143 to secure the components attached to the liner 170 to the rose 156.

Figure 4:
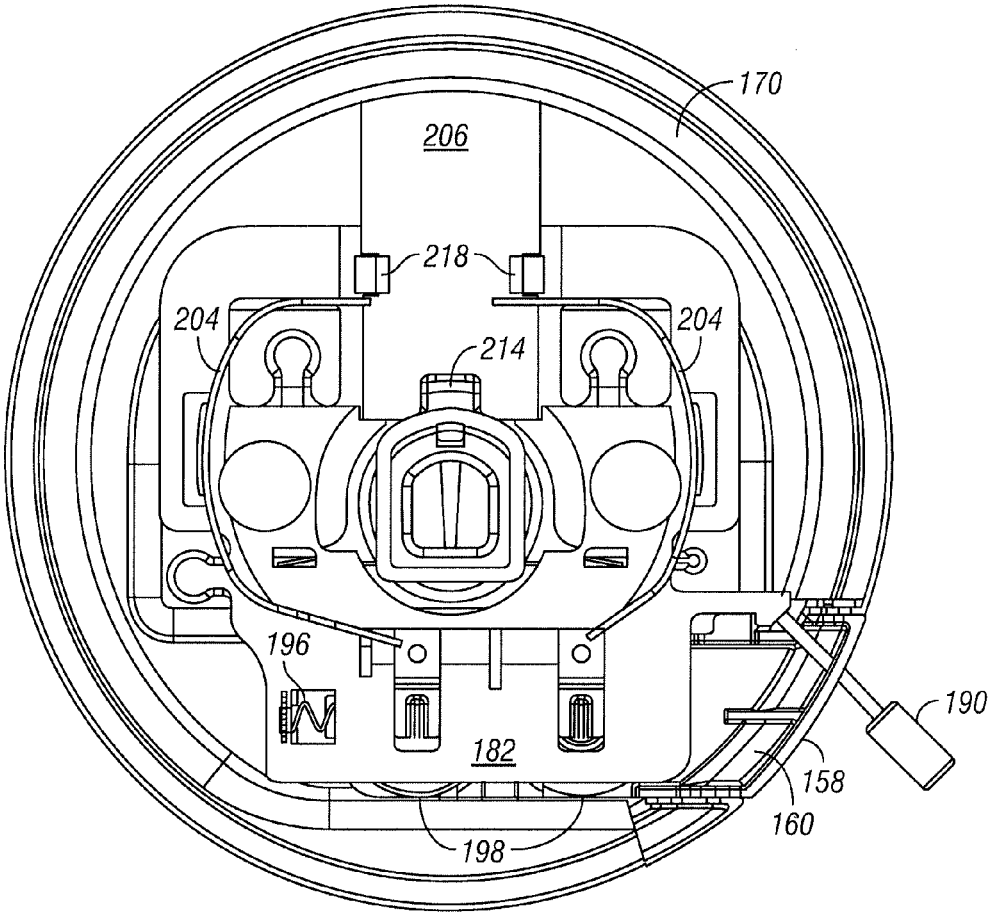
FIG. 4 is a rear view of the interior locking assembly according to one embodiment.
Figure 5:
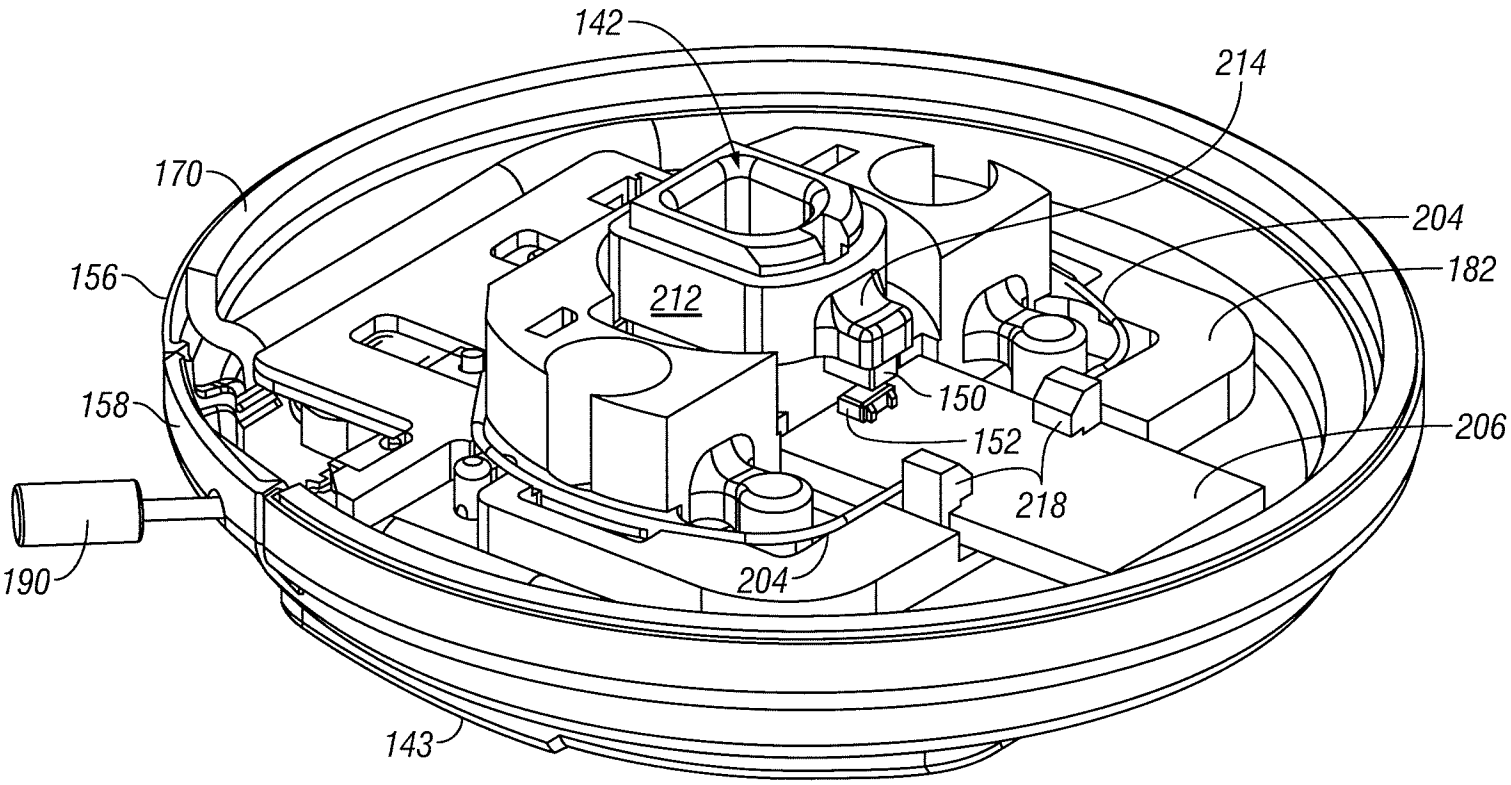
FIG. 5 is a detailed view of the interior locking assembly of FIG. 4 showing the magnetic sensor and magnet.

Referring to FIGS. 4 and 5, it can be seen that in the position shown the magnet 150 is proximate the magnetic sensor 152 such that the magnetic force can be detected by the magnetic sensor 152. If the turnpiece 143 is rotated, however due to rotation of the turnpiece 143, this will rotate the magnet 150 to a position in which the magnetic sensor 152 will not be able to detect the magnetic force. Accordingly, the detection of a sufficient magnetic force by the magnetic sensor 152 can be used to determine a position of the bolt 124 based on the position of the magnet 150.

The processor 208 could be configured to illuminate the light 154 based on the magnetic sensor 152 either detecting the magnet or the absence of the magnet. Consider an example in which the processor 208 is configured such that the light 154 is illuminated when the magnetic sensor 152 does not detect the magnet 150. In such an embodiment, for example, the magnet 150 would positioned proximate to the magnetic sensor 152 when the bolt 124 is in the retracted position (i.e., the turnpiece 143 is in a position in which the locking assembly 100 is unlocked), but away from the magnetic sensor 152 when the bolt 124 is in an extended position (i.e., the turnpiece 143 is in a position in which the locking assembly 100 is locked). Accordingly, when the user rotates the turnpiece 143 to lock the locking assembly 100, this will rotate the magnet 150 away from the magnetic sensor 152 to a position in which the magnetic sensor 152 does not detect the magnetic energy from the magnet 150. When the processor 208 receives an input from the magnetic sensor 152 that the magnet 150 is longer detected, the processor 208 will turn on the light 154. Accordingly, the user could determine that the locking assembly 100 is locked based on the light 154 being illuminated.

Consider another example in which the processor 208 is configured such that the light 154 is illuminated when the magnetic sensor 152 detects the magnet 150. In such an embodiment, for example, the magnet 150 would positioned away from the magnetic sensor 152 when the bolt 124 is in the retracted position (i.e., the turnpiece 143 is in a position in which the locking assembly 100 is unlocked), but proximate the magnetic sensor 152 when the bolt 124 is in an extended position (i.e., the turnpiece 143 is in a position in which the locking assembly 100 is locked). Accordingly, when the user rotates the turnpiece 143 to lock the locking assembly 100, this will rotate the magnet 150 toward from the magnetic sensor 152 to a position in which the magnetic sensor detects the magnetic energy from the magnet 150. When the processor 208 receives an input that the magnetic sensor 152 detects the magnetic sensor, the processor 208 would turn on the light 154. Accordingly, the user could determine that the locking assembly 100 is locked based on the light 154 being illuminated.

Although the present disclosure has been described with reference to particular means, materials, and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. A deadbolt assembly comprising:

a bolt movable between an extended position and a retracted position;

an interior locking assembly comprising:

a rose including an interior surface defining an interior cavity and exterior surface on an opposite side of the rose from the interior surface, wherein the rose includes an opening therethrough;

a turnpiece extending from the exterior surface of the rose and being rotatable to move the bolt between the extended position and the retracted position, wherein the turnpiece includes a shank extending into the interior cavity through the opening in the rose;

a magnet disposed in the interior cavity defined by the rose, the magnet being attached to a magnet carrier, the magnet being rotatable with the turnpiece;

a light;

a detection circuit configured to detect when the bolt is in the extended position, the detection circuit comprising a magnetic sensor disposed in the interior cavity and is configured to actuate the light responsive to either: (1) detecting the magnet; or (2) detecting the absence of the magnet;

wherein the magnet is rotatable between a first position corresponding with a position in which the bolt is in an extended position and a second position corresponding with a position in which the bolt is in a retracted position;

wherein the magnet is positioned on the shank to be undetectable by the magnetic sensor in the first position and detectable by the magnetic sensor in the second position.

2. A deadbolt assembly comprising:

a bolt movable between an extended position and a retracted position;

a turnpiece rotatable to move the bolt between the extended position and the retracted position;

a magnet carrier including a magnet, wherein the magnet carrier and the magnet are rotatable with the turnpiece;

a magnetic sensor configured to (1) detect the magnet; or (2) detect the absence of the magnet;

a light; and a processor electrically coupled with the light and magnetic sensor, wherein the processor is configured to actuate the light responsive to the magnetic sensor either: (1) detecting the magnet; or (2) detecting the absence of the magnet;

wherein the magnet is rotatable between a first position corresponding with a position in which the bolt is in an extended position and a second position corresponding with a position in which the bolt is in a retracted position; and wherein the magnet is undetectable by the magnetic sensor in the first position and detectable by the magnetic sensor in the second position.

3. A deadbolt assembly comprising:

a bolt movable between an extended position and a retracted position;

an interior locking assembly defining an interior cavity, wherein the interior locking assembly includes:

a turnpiece rotatable to move the bolt between the extended position and the retracted position;

a light;

means for actuating the light responsive to the bolt being in the extended position, wherein the actuating means is entirely disposed in the interior cavity, and wherein the actuating means comprises a magnet coupled to-a shank of the turnpiece, the magnet rotatable with rotation of the turnpiece;

wherein the actuating means includes an electrical device disposed in the interior cavity that is configured to detect when the bolt is in the extended position;

wherein the magnet is rotatable between a first position corresponding with a position in which the bolt is in an extended position and a second position corresponding with a position in which the bolt is in a retracted position;

wherein the magnet is undetectable by the magnetic sensor in the first position and detectable by the magnetic sensor in the second position.

* * * * *